US006851222B2

(12) United States Patent
Albiero

(10) Patent No.: US 6,851,222 B2
(45) Date of Patent: Feb. 8, 2005

(54) SAFETY EDGE FOR HORIZONTALLY PIVOTED ROLLING GATES

(75) Inventor: Francesco Albiero, Desenzano del Garda (IT)

(73) Assignee: Stagnoli T.G. S.r.l., Desenzano del Garda (IT)

( * ) Notice: Subject to any disclaimer, the term of this patent is extended or adjusted under 35 U.S.C. 154(b) by 0 days.

(21) Appl. No.: 10/093,315

(22) Filed: Mar. 7, 2002

(65) Prior Publication Data

US 2002/0124973 A1 Sep. 12, 2002

(30) Foreign Application Priority Data

Mar. 12, 2001 (IT) ..... BS2001A 0019

(51) Int. Cl.[7] ..... E05F 15/02
(52) U.S. Cl. ..... 49/27; 49/197
(58) Field of Search ..... 49/26, 27, 28, 49/197, 199; 200/61.43

(56) References Cited

U.S. PATENT DOCUMENTS 3,277,256 A * 10/1966 Jones ..... 49/26
3,851,125 A * 11/1974 Deming et al. ..... 49/199
4,819,379 A * 4/1989 Kenzelmann et al. ..... 49/199
4,943,757 A * 7/1990 Richter et al. ..... 49/28
5,459,962 A * 10/1995 Bonne et al. ..... 49/28
5,481,076 A * 1/1996 Mullet et al. ..... 49/27
5,920,044 A * 7/1999 Kaji et al. ..... 200/61.44
5,932,931 A * 8/1999 Tanaka et al. ..... 307/10.1
5,998,951 A * 12/1999 Dove ..... 49/28
6,389,752 B1 * 5/2002 Rosenau ..... 49/28
6,427,382 B2 * 8/2002 Gregoriou et al. ..... 49/27

FOREIGN PATENT DOCUMENTS

EP 0381578 * 8/1990 ..... 49/28

* cited by examiner

*Primary Examiner*—Jerry Redman
(74) *Attorney, Agent, or Firm*—McGlew and Tuttle, P.C.

(57) ABSTRACT

The invention relates to a safety edge for horizontally pivoted rolling gates actuated by a motor unit. It consists of a profile (11) made of rubber or other soft flexible material and having a base (14) for its application to a rolling date, and of two electrical conductors (15, 16) extending longitudinally into the soft profile, parallel and normally separate from one another. The conductors move closer in the presence of a deforming thrust on said profile, to come into contact and enable an electrical circuit to send a signal for stopping the rolling gate motor unit.

9 Claims, 2 Drawing Sheets

SAFETY EDGE FOR HORIZONTALLY PIVOTED ROLLING GATES

FIELD OF APPLICATION

The present finding relates to the field of horizontally pivoted rolling gates and similar automated devices, and in particular, it relates to a safety edge applicable as safety means to such closing systems.

PRIOR ART

The application of a so-called safety edge to horizontally pivoted rolling gates is already known. It consists of a rubber or soft material profile and a traction cable extending into the rubber profile and connecting to at least one microswitch, normally closed, inserted in the electrical circuit of the motor controlling the rolling gate. Since the edge is not stressed, the microswitch remains closed and the rolling gate is not enabled to operate regularly. If, on the other hand, during the rolling gate movement, usually while closing, the edge detects or interferes with a foreign element that hinders it motion, the stressed cable causes the microswitch to open, thus opening the electrical circuit of the motor unit and stopping the rolling gate to prevent damages to people or things.

In such safety edge, the cable essentially has the function of actuating means for the mechanical drive of a control to at least one microswitch. In another embodiment, a safety edge to be used on rolling gates uses laminations or crop ends of laminations s actuators, but always associated to current switches.

PURPOSE AND SUMMARY OF THE INVENTION

Purpose of the present finding is that of implementing and providing an improved safety edge for motor-driven rolling gates embedding electrical conductor means for its entire length, and acting at the same time, in any part of the edge, as means for stopping the rolling gate motor unit when the edge comes into contact with an obstacle, or is in any case stressed by a thrust.

Another purpose of the invention is that of providing a high-efficiency safety edge for rolling gates, easy to realise and convenient to be installed without having to use special angle joins when the edge is arranged on more sides of a rolling gate.

Such purposes are obtained, according to the present finding, by a safety edge for motor-driven rolling gates consisting of a rubber profile, or made of another soft, flexible material, and of two electrical conductors extending longitudinally into said profile in parallel, normally separate from one another and movable closer to come into contact in the presence of a deforming thrust on said profile and enable an electrical circuit to send a signal for stopping the rolling gate motor unit.

BRIEF DESCRIPTION OF THE DRAWINGS

Further features of the invention will appear more clearly from the following description, made with reference to the attached indicative and non-limiting drawings. In such drawings

DETAILED DESCRIPTION OF THE INVENTION

Figure 1:
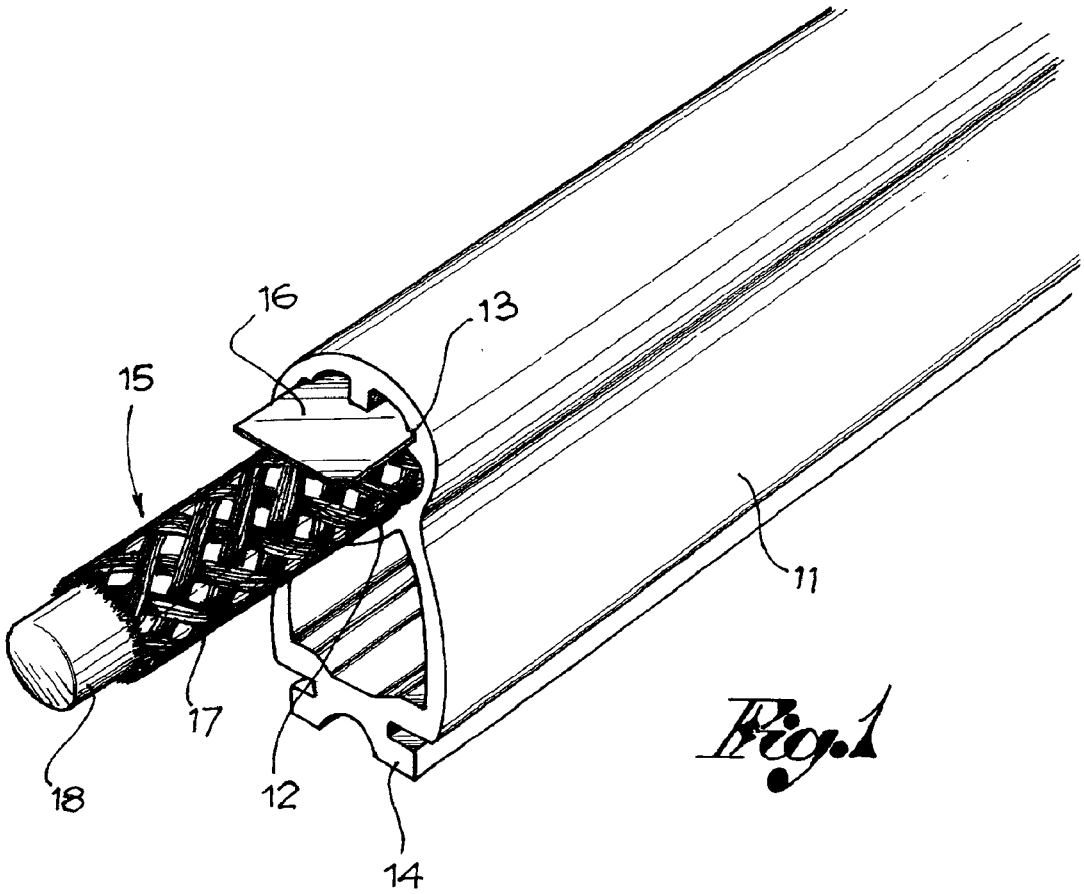
FIG. 1 shows a perspective view of a crop end of safety edge.
Figure 2:
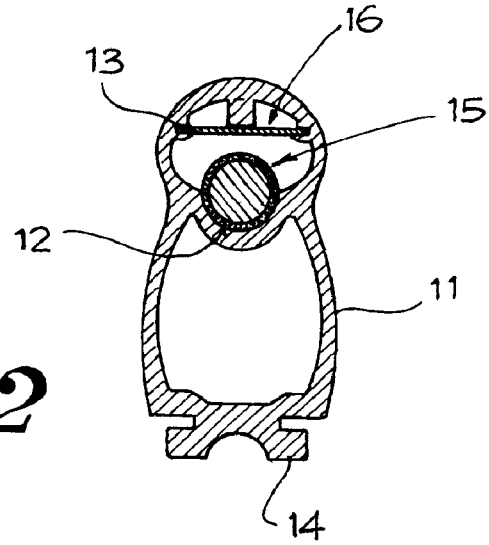
FIG. 2 shows a transversal section of the safety edge.

The safety edge shown comprises a soft extruded profile 11 made of rubber or other flexible material, which longitudinally exhibits a first seat 12 and a second seat 13, shaped as channels, parallel and open the one towards the other. The first longitudinal seat 12 is closer to the base 14 of the profile than the second channel-shaped seat 13.

The first longitudinal seat 12 houses and holds a first electrical conductor 15, and the other longitudinal seat 13 houses a second electrical conductor 16. The two conductors 15, 16 extend for the entire length of profile 11, and the first of them preferably exhibits a round, half-round, elliptical or similar section, whereas the second one preferably exhibits a flat section, such as in the shape of a tape, in any case flexible.

The first conductor 15 consists, for example, of a conductor braiding or mesh 17 arranged around an insulating core 18, and is exposed towards the second flat conductor 16 with a rounded portion of its surface. For the realisation of the edge, the soft profile 11 can be extruded around one or both conductors, embedding them. Or, conductors 15, 16 can be inserted into the respective seats 12, 13 of the soft profile 11 after its extrusion.

In any case, conductors 15, 16 remain parallel and normally separate from one another when the safety edge is at rest.

Figure 3:
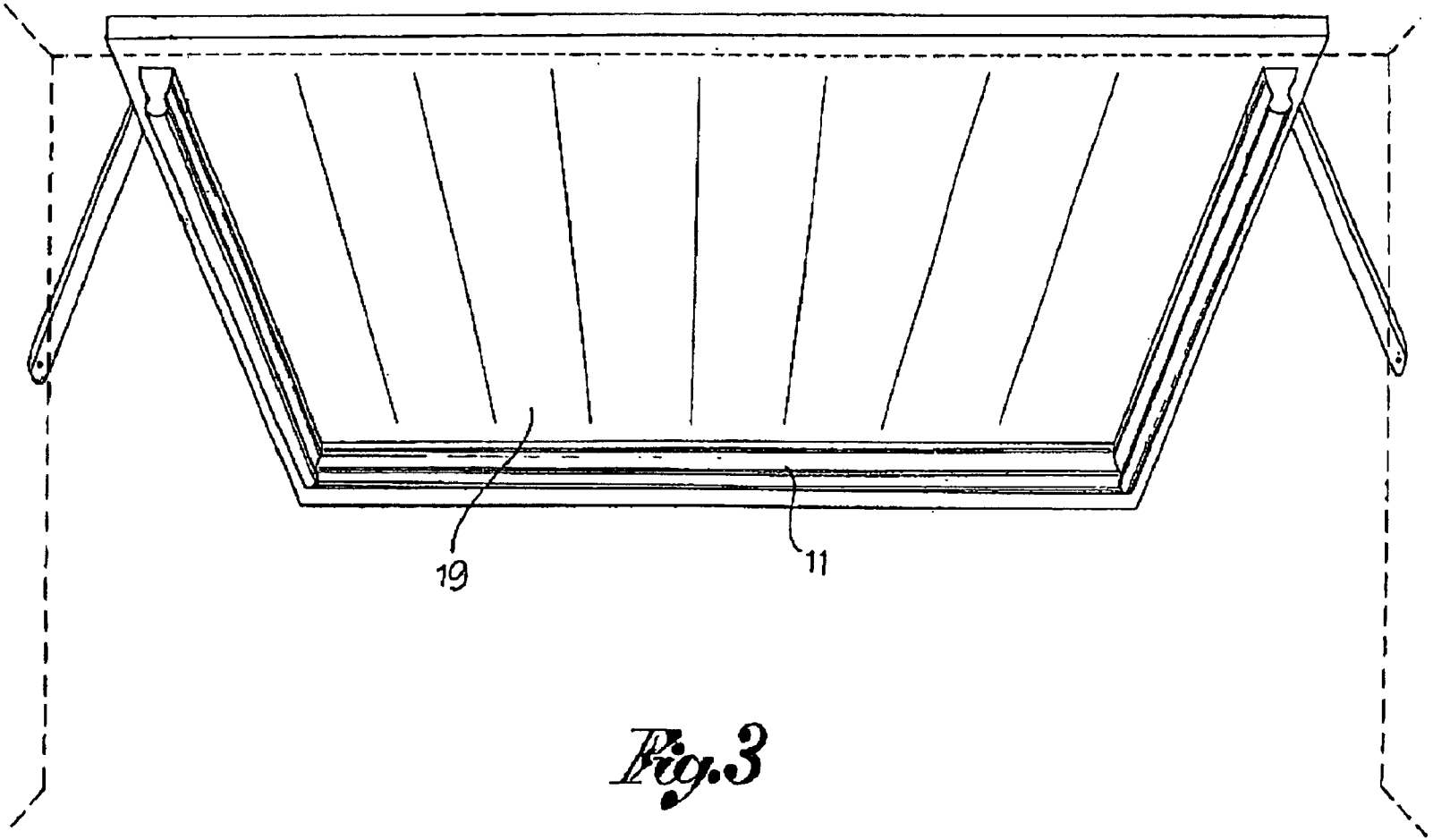
FIG. 3 schematically shows a horizontally pivoted rolling gate complete with safety edge.

The edge thus structured is applied with its base 14 to the edges of a horizontally pivoted rolling gate 19, as shown in FIG. 3, for example, and conveniently inserted through the conductors into the electrical circuit of the motor unit controlling the gate.

As long as the edge is at rest, since it is not stressed by external thrusts, the conductors remain separate and the rolling gate operates normally. If during the rolling gate motion, any part of the edge meets an obstacle or a hindrance, so as to be stressed and compressed by an external source, the conductors close on one another, thus causing an immediate halt of the motor unit, and thereby of the rolling gate. Given the shape and the association of the conductors, the safety edge trips in the presence of both orthogonal and inclined thrusts with respect to the profile base.

What is claimed is:

1. An automated closing system comprising:

a door having an edge;

a motor moving said door between open and a closed position;

a profile arranged on said edge or adjacent thereto of said door and extending away from said door, said profile including a base arranged on or adjacent to said edge;

a first electrical conductor arranged in said profile;

a second electrical conductor arranged in said profile and arranged spaced from said first electrical conductor, said profile being formed of a flexible material, and having a shape, to bring said first electrical conductor into contact with said second electrical conductor when said profile experiences forces in orthogonal and inclined directions with respect to said base of said profile, contact of said first and second conductors generating a signal which is sent to said motor and stops said motor, wherein said door is moved between said open and said closed position and has an upper side, a lower side, two lateral sides and, said profile extends along or adjacent to substantially the entire length of said lower side and said two lateral sides.

2. A system in accordance with claim 1, wherein:

said shape of said profile brings said first conductor into contact with said second conductor when any part of said profile comes into contact with an obstacle.

3. A system in accordance with claim 1, wherein:

said shape of said profile brings said first conductor into contact with said second conductor when any or all parts of a surface of said profile experiences forces.

4. A system in accordance with claim 1, wherein:

said shape of said profile brings said first conductor into contact with said second conductor when said profile experiences forces in both said orthogonal and said inclined directions.

5. A safety edge system comprising: a door movable by a motor unit, at least one portion of the door movable between a substantially horizontal position to a substantially vertical position, said door having a closing edge movable into a closed position adjacent to a ground surface; and a profile disposed adjacent to said cloning edge, said profile comprising:

a longitudinally extending profile support structure formed of a flexible material and with abase connected to said door, a profile portion connected to said base, said profile portion defining a chamber, a first seat spaced from said base by said profile portion, with said chamber between said first seat and said base and a second seat with a channel portion defining a gap between said first seat and said second scat, said first seat being between said chamber and said second seat;

a longitudinally extending first electrical conductor arranged in said first seat;

a longitudinally extending second electrical conductor arranged in said second seat spaced from said first electrical conductor, said profile support structure having a shape, to bring said first electrical conductor into contact with said second electrical conductor when said profile experiences forces in orthogonal and inclined directions with respect to said base of said profile, contact of said first and second conductors generating a signal which is sent to the motor unit to stop the motor unit, wherein said first conductor has around surface facing said second conductor and said second conductor has a flat section, and said first conductor includes a conductor braiding or mesh arranged around an insulating core and said second conductor including a conductive element shaped as a flexible tape.

6. A safety edge according to claim 5, wherein said first seat extends longitudinally and in parallel to said second seat.

7. A safety edge according to claim 5, wherein the first conductor has a rounded surface with a portion held in said first seat and an exposed portion facing said second conductor, said second conductor having a flat section opposite said exposed portion.

8. A safety profile edge element, comprising:

a longitudinally extending profile support structure formed of a flexible material and with a base for connection to a door, a profile portion connected to said base, said profile portion defining a chamber, a first seat spaced from said base by said profile portion, with said chamber between said first seat and said base and a second seat with a channel portion defining a gap between said first seat and said second seat, said first seat being between said chamber and said second seat;

a longitudinally extending first electrical conductor arranged in said first seat;

a longitudinally extending second electrical conductor arranged In said second seat spaced from said first electrical conductor, said profile support structure having a shape, to bring said first electrical conductor into contact with said second electrical conductor when said profile experiences forces in orthogonal and inclined directions with respect to said base of said profile, contact of said first and second conductors generating a signal which is sent to the motor unit to stop the motor unit, wherein said first conductor has a rounded surface facing said second conductor and said second conductor has a flat section said first conductor including a conductor braiding or mesh arranged around an insulating core and said second conductor including a conductive element shaped as a flexible tape.

9. A safety profile edge element according to claim 8, wherein said first seat extends longitudinally and in parallel to said second seat.

* * * * *